US007908878B2

(12) United States Patent
Okamoto

(10) Patent No.: US 7,908,878 B2
(45) Date of Patent: Mar. 22, 2011

(54) REFRIGERATING APPARATUS

(75) Inventor: Masakazu Okamoto, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 649 days.

(21) Appl. No.: 11/919,225

(22) PCT Filed: Apr. 3, 2006

(86) PCT No.: PCT/JP2006/307067

§ 371 (c)(1),
(2), (4) Date: Oct. 25, 2007

(87) PCT Pub. No.: WO2006/117959

PCT Pub. Date: Nov. 9, 2006

(65) Prior Publication Data

US 2010/0146999 A1 Jun. 17, 2010

(30) Foreign Application Priority Data

Apr. 28, 2005 (JP) ..... 2005-131736

(51) Int. Cl.
*F25B 41/04* (2006.01)

(52) U.S. Cl. ..... 62/204; 62/199

(58) Field of Classification Search ..... 62/238.6, 62/498, 513, 199, 204, 205, 210
See application file for complete search history.

(56) References Cited

U.S. PATENT DOCUMENTS

| | | | | |
|---|---|---|---|---|
| 2,677,944 | A * | 5/1954 | Ruff | 62/192 |
| 3,355,903 | A * | 12/1967 | La Fleur | 62/88 |
| 4,086,072 | A * | 4/1978 | Shaw | 62/160 |
| 4,197,719 | A * | 4/1980 | Shaw | 62/324.1 |
| 5,191,776 | A | 3/1993 | Severance et al. | |
| 5,974,829 | A * | 11/1999 | Novak et al. | 62/617 |
| 6,523,347 | B1 * | 2/2003 | Jirnov et al. | 60/651 |
| 7,669,647 | B2 * | 3/2010 | Tsubone et al. | 165/202 |

FOREIGN PATENT DOCUMENTS

| | | | |
|---|---|---|---|
| JP | 58-55246 | U | 4/1983 |
| JP | 5-223370 | A | 8/1993 |
| JP | 5-223370 | A | 8/1993 |
| JP | 2003-121015 | A | 4/2003 |

* cited by examiner

*Primary Examiner* — Melvin Jones
(74) *Attorney, Agent, or Firm* — Birch, Stewart, Kolasch & Birch, LLP.

(57) ABSTRACT

Refrigerant sent from a heat source side circuit (14) to utilization side circuits (11, 12, 13) is made to be single-phase liquid by using cooling means (36, 45) or a vapor-liquid separator (35). Variable-opening utilization side expansion valves (51, 52, 53) are provided in the utilization side circuits (11, 12, 13) so that an expansion process in a refrigeration cycle is performed also in the circuits.

6 Claims, 8 Drawing Sheets

REFRIGERATING APPARATUS

TECHNICAL FIELD

The present invention relates to a multi type refrigerating apparatus in which a plurality of user side circuits are connected in parallel to a heat source side circuit.

BACKGROUND ART

Multi type refrigerating apparatuses have been known conventionally in which a plurality of user side circuit are connected in parallel to a heat source side circuit and user side heat exchangers provided in the user side circuits serve as evaporators to perform a cooling operation for a refrigeration cycle. The refrigerating apparatuses of this kind are used as air conditioners for air conditioning in rooms by indoor units in which the user side circuits are provided, for example.

The refrigerating apparatuses of this kind are grouped into two of: one performing the expansion stroke of the refrigeration cycle in the user side circuits with an expansion valve provided in each user side circuit; and the other performing the expansion cycle of the refrigeration cycle in the heat source side circuit with an expander provided in the heat source side circuit (see Patent Document 1, for example). The latter refrigerating apparatus is more excellent in COP (coefficient of performance) than the former one because a compressor can be driven by utilizing power generated in association with expansion of the refrigerant and recovered in the expander. In the latter refrigerating apparatus, however, the refrigerant flowing out from the expander is in a two-phase state of vapor and liquid. The refrigerant in the two-phase state receives influence of the gravity and pressure loss in moving to the user side circuits in the cooling operation to cause imbalance in the state of the supplied refrigerant (a ratio of liquid refrigerant to gas refrigerant) between the user side circuits, thereby inviting difficulty in control on cooling capacity. For example, if the installation levels of the user side circuits are different from each other, the refrigerant supplied to the upper user side circuit has a greater ratio of the gas refrigerant, so that the refrigerant goes short in the upper user side circuit, inviting difficulty in appropriate adjustment of the cooling capacity.

Patent Document 1: Japanese Patent Application Laid Open Publication No. 2003-121015

SUMMARY OF THE INVENTION

Problems that the Invention is to Solve

In the conventional refrigerating apparatus, the refrigerant in the gas-liquid two-phase state flowing out from the expander is distributed to the user side circuits in the cooling operation. The liquid refrigerant and the gas refrigerant of the refrigerant in the gas-liquid two-phase state are different form each other in gravity and pressure loss received in moving. This involves difficulty in accurate adjustment of each amount of the refrigerants supplied to the user side circuits, leading to difficulty in appropriate adjustment of the cooling capacity of each user side circuit.

Further, the refrigerating apparatus of Patent Document 1 sends only the liquid refrigerant separated in a gas-liquid separator to the user side circuits, and less or no difference in pressure of the refrigerant is observed between at the outlet of the heat source side circuit and at the inlets of the user side circuits. Accordingly, in the case where the user side circuits receive different pressure losses caused in the course of refrigerant flowing from the heat source side circuit to the user side circuits, such as the case where the user side circuits are different from each other in installation level or piping length from the heat source side circuit, it is difficult to adjust the cooling capacity of each user side circuit appropriately. Specifically, even if the amount of the refrigerant supplied to each user side circuit is adjusted by providing flow adjusting valves, since the refrigerant is liable to less flow in a user side circuit receiving a large pressure loss caused between the heat source side circuit and the user side circuit, the refrigerant may be supplied insufficiently. As a result, insufficient cooling is performed with the short amount of the refrigerant in the user side circuit.

The present invention has been made in view of the foregoing and has its object of achieving, in a refrigerating apparatus in which a plurality of user side circuits are connected in parallel to a heat source side circuit including an expander, appropriate adjustment of the cooling capacity of each user side circuit in a cooling operation irrespective of the location of the user side circuits.

Means for Solving the Problems

A first aspect of the present invention is directed to a refrigerating apparatus (20) which includes a refrigerant circuit (10) performing a refrigeration cycle by circulating refrigerant, the refrigerant circuit (10) including: a heat source circuit (14) provided with a compressor (30), an expander (31), and a heat source side heat exchanger (44) and a plurality of user side circuits (11, 12, 13) respectively provided with user side heat exchangers (41, 42, 43) and connected in parallel to the heat source side circuit (14), and which is capable of performing a cooling operation where the heat source side heat exchanger (44) serves as a condenser while the user side heat exchangers (41, 42, 43) serve as evaporators. Wherein, the refrigerating apparatus is capable of performing a cooling operation where the heat source side heat exchanger (44) serves as a condenser while the user side heat exchangers (41, 42, 43) serve as evaporators, and the heat source side circuit (14) includes cooling means (36, 45) for cooling the refrigerant sent from the expander (31) to the user side circuits (11, 12, 13) in the cooling operation.

Referring to a second aspect of the present invention, in the first aspect, the user side circuits (11, 12, 13) include opening variable user side expansion valves (51, 52, 53) on upstream sides in the cooling operation of the user side heat exchangers (41, 42, 43), respectively.

Referring to a third aspect of the present invention, in the second aspect, the cooling means (36, 45) includes a cooling expansion mechanism (36) which reduces a pressure of a part of the refrigerant having been condensed in the heat source side heat exchanger (44) and flowing therein and a cooling heat exchanger (45) which cools the refrigerant sent from the expander (31) to the user side circuits (11, 12, 13) by heat exchange with the refrigerant of which pressure has been reduced in the cooling expansion mechanism (36).

A fourth aspect of the present invention is directed to a refrigerating apparatus (20) which includes a refrigerant circuit (10) performing a refrigeration cycle by circulating refrigerant, the refrigerant circuit (10) including: a heat source circuit (14) provided with a compressor (30), an expander (31), and a heat source side heat exchanger (44) and a plurality of user side circuits (11, 12, 13) respectively provided with user side heat exchangers (41, 42, 43) and connected in parallel to the heat source side circuit (14), and which is capable of performing a cooling operation where the heat source side heat exchanger (44) serves as a condenser while the user side heat exchangers (41, 42, 43) serve as evaporators. Wherein, the user side circuits (11, 12, 13) include opening variable user side expansion valves (51, 52, 53) on upstream sides in the cooling operation of the user side heat exchangers (41, 42, 43), respectively, and the heat source side circuit (14) includes a gas-liquid separator (35) for separating the refrigerant flowing from the expander (31) into liquid refrigerant and gas refrigerant and for sending the liquid refrigerant to the user side circuits (11, 12, 13).

Referring to a fifth aspect of the present invention, in the fourth aspect, a gas pipe (37) for sending the gas refrigerant in the gas-liquid separator (35) to the compressor (30) is mounted at the gas-liquid separator (35).

Referring to a sixth aspect of the present invention, in the fourth aspect, the compressor (30) includes a low-stage compression mechanism (30*a*) and a high-stage compression mechanism (30*b*) which are connected to each other in series, the high-pressure compression mechanism (30*b*) compressing further refrigerant having been compressed in the low-stage compression mechanism (30*a*), and a gas pipe (37) for sending the gas refrigerant in the gas-liquid separator (35) to the high-stage compression mechanism (30*b*) is mounted at the gas-liquid separator (35).

Referring to a seventh aspect of the present invention, in any one of the first to sixth aspects, the refrigerant circuit (10) is set so that a high pressure of the refrigeration cycle is higher than a critical pressure of the refrigerant.

—Operation—

In the first aspect, the refrigerant condensed in the heat source side heat exchanger (44) flows into the expander (31) in the heat source side circuit (14) in the cooling operation. The refrigerant expanded in the expander (31) is in a gas-liquid two-phase state where gas refrigerant and liquid refrigerant are present. The refrigerant in the gas-liquid two-phase state flowing out from the expander (31) is cooled in the cooling means (36, 45) so that the gas refrigerant included therein is liquefied to be in a single liquid state. The liquid refrigerant cooled in the cooling means (36, 45) is distributed to the user side circuits (11, 12, 13).

In the second aspect, the opening variable user side expansion valves (51, 52, 53) are provided in the user side circuits (11, 12, 13), respectively, so that the refrigerant expanded in the expander (31) of the heat source side circuit (14) can be expanded also in the user side circuits (11, 12, 13) in the cooling operation. Namely, the expansion stroke of the refrigeration cycle is performed not only in the heat source side circuit (14) but also in the user side circuits (11, 12, 13).

In the third aspect, the cooling expansion mechanism (36) and the cooling heat exchanger (45) composing the cooling means (36, 45) are used for cooling the refrigerant in the gas-liquid two-phase state flowing from the expander (31). In the cooling expansion mechanism (36), a part of the refrigerant condensed in the heat source side heat exchanger (44) is expanded to a have low temperature and a low pressure. The refrigerant in the gas-liquid two-phase state flowing out from the expander (31) is heat exchanged with the refrigerant of which temperature and pressure have been lowered by being cooled in the cooling expansion mechanism (36) of the cooling heat exchanger (45), thereby being cooled.

In the fourth aspect, similarly to the third aspect, the opening variable user side expansion valves (51, 52, 53) are provided in the user side circuits (11, 12, 13), respectively, so that the expansion stroke of the refrigeration cycle is performed not only in the heat source side circuit (14) but also in the user side circuits (11, 12, 13). Further, the gas-liquid separator (35) is provided for separating the refrigerant flowing therein from the expander (31) into the liquid refrigerant and the gas refrigerant, wherein only the liquid refrigerant is distributed to the user side circuits (11, 12, 13). The liquid refrigerant sent from the gas-liquid separator (35) to the user side circuits (11, 12, 13) is reduced in pressure by the user side expansion valves (1, 52, 53) and then flows into the user side heat exchangers (41, 42, 43).

In the fifth aspect, the gas pipe (37) is mounted at the gas-liquid separator (35) so that the gas refrigerant in the gas-liquid separator (35) is sent to the compressor (30). The refrigerant flowing out from the expander (31) is separated by the gas-liquid separator (35) into the liquid refrigerant and the gas refrigerant, wherein only the gas refrigerant is sent to the compressor (30) through the gas pipe (37).

In the sixth aspect, the refrigerant evaporated in the user side heat exchangers (41, 42, 43) is sucked into the low-stage compression mechanism (30*a*) in the cooling operation. The gas refrigerant compressed and overheated in the low-stage compression mechanism (30*a*) is sent to the high-stage compression mechanism (30*b*). The gas refrigerant in a saturated state in the gas-liquid separator (35) is sent as well to the high-stage compression mechanism (30*b*) through the gas pipe (37). The high-stage compression mechanism (30*b*) sucks and compresses the gas refrigerant from the low-stage compression mechanism (30*a*) and the gas refrigerant from the gas-liquid separator (35).

In the seventh aspect, the refrigerant is compressed by the compressor (30) to have a pressure higher than the critical pressure of the refrigerant. Accordingly, the refrigerant discharged from the compressor (30) is in a supercritical state. In consequence, no liquid refrigerant is included at least in the discharged refrigerant even if damp refrigerant is sucked to the compressor (30), thereby definitely preventing generally-called liquid compression.

EFFECTS OF THE INVENTION

In the first to third aspects, the refrigerant in the gas-liquid two-phase state flowing out from the expander (31) is cooled by the cooling means (36, 45) of the heat source side circuit (14) to be forcedly in the single liquid state and is then distributed to the user side circuits (11, 12, 13) in the cooling operation. Namely, the refrigerant in the single liquid phase state flows in the pipe in which the refrigerant flows from the heat source side circuit (14) to the user side circuits (11, 12, 13) in the cooling operation so that the liquid refrigerant is supplied to the user side circuits (11, 12, 13). Accordingly, supply of the liquid refrigerant to the user side circuits (11, 12, 13) causes no imbalance in the state of the refrigerant (a ratio of the liquid refrigerant to the gas refrigerant) even if the user side circuits (11, 12, 13) are different from each other in pressure loss caused in the course of refrigerant flowing from the heat source side circuit (14) to the user side circuits (11, 12, 13). As a result, each amount of refrigerants supplied to the user side circuits (11, 12, 13) can be appropriately controlled when compared with the case where the refrigerant in the gas-liquid two-phase state is sent from the heat source side circuit (14) to the user side circuits (11, 12, 13). Hence, the controllability on cooling capacity of each user side circuit (11, 12, 13) in the cooling operation is enhanced irrespective of the location of the user side circuits (11, 12, 13).

In the second aspect, the opening variable user side expansion valves (51, 52, 53) are provided in the user side circuits (11, 12, 13), respectively, so that the expansion stroke of the refrigerating cycle is performed also in the user side circuits (11, 12, 13). Accordingly, in the case where the user side circuits (11, 12, 13) receive different pressure losses caused in the course of refrigerant flowing from the heat source side circuit (14) to the user side circuits (11, 12, 13), the difference in pressure loss between the user side circuits (11, 12, 13) can be adjusted by the user side expansion valves (51, 52, 53). In other words, in the second aspect, even if the user side circuits (11, 12, 13) are different from each other in pipe length from the heat source side circuit (14) or in installation levels, adjustment of each opening of the user side expansion valves (51, 52, 53) achieves arbitrary setting of each amount of the refrigerants flowing in the user side circuits (11, 12, 13). Hence, each amount of the refrigerants supplied to the user side circuits (11, 12, 13) can be controlled appropriately irrespective of the location of the user side circuits (11, 12, 13), thereby enhancing the controllability on cooling capacity of each user side circuit (11, 12, 13) in the cooling operation.

In the fourth aspect, the refrigerant sent from the heat source side circuit (14) to the user side circuits (11, 12, 13) is allowed to be in the single liquid phase state by the gas-liquid separator (35) in the cooling operation. Further, the opening variable user side expansion valves (51, 52, 53) are provided in the user side circuits (11, 12, 13), respectively, so that the expansion stroke of the refrigeration cycle is performed not only in the heat source side circuit (14) but also in the user side circuits (11, 12, 13). With the gas-liquid separator (35) provided, imbalance of the state of the refrigerant supplied between the user side circuits (11, 12, 13) is prevented from being caused even in the case where the user side circuits (11, 12, 13) are different from each other in pressure loss caused in the course of refrigerating flowing from the heat source side circuit (14) to the user side circuits (11, 12, 13). In addition, adjustment of each opening of the user side expansion valves (51, 52, 53) achieves arbitrary setting of each amount of the refrigerants flowing in the user side circuits (11, 12, 13). Hence, each amount of the refrigerants supplied to the user side circuits (11, 12, 13) can be controlled appropriately irrespective of the location of the user side circuits (11, 12, 13), thereby enhancing the controllability on cooling capacity of each user side circuit (11, 12, 13) in the cooling operation.

In the sixth aspect, not only the overheated gas refrigerant from the low-stage compression mechanism (30*a*) but also the saturated gas refrigerant from the gas-liquid separator (35) are supplied to the high-stage compression mechanism (30*b*). This lowers the enthalpy of the refrigerant sucked in the high-stage compression mechanism (30*b*) to reduce power required for compression in the high-stage compression mechanism (30*b*), thereby increasing the COP (coefficient of performance). In addition, the temperature of the refrigerant discharged from the high-stage compression mechanism (30*b*) lowers, thereby suppressing degradation of the oil and decomposition of the refrigerant.

In the seventh aspect, the refrigerant circuit (10) performs the supercritical cycle where the high pressure of the refrigeration cycle is higher than the critical pressure of the refrigerant, so that the refrigerant discharged from the compressor (30) is in the overheated state reliably. This allows the refrigerant discharged from the compressor (30) to be already in the overheated state even if damp refrigerant is sucked in the compressor (30), preventing liquid compression in the compressor (30) definitely. As a result, the reliability of the refrigerating apparatus (20) increases.

EXPLANATION OF REFERENCE NUMERALS

Figure 1:
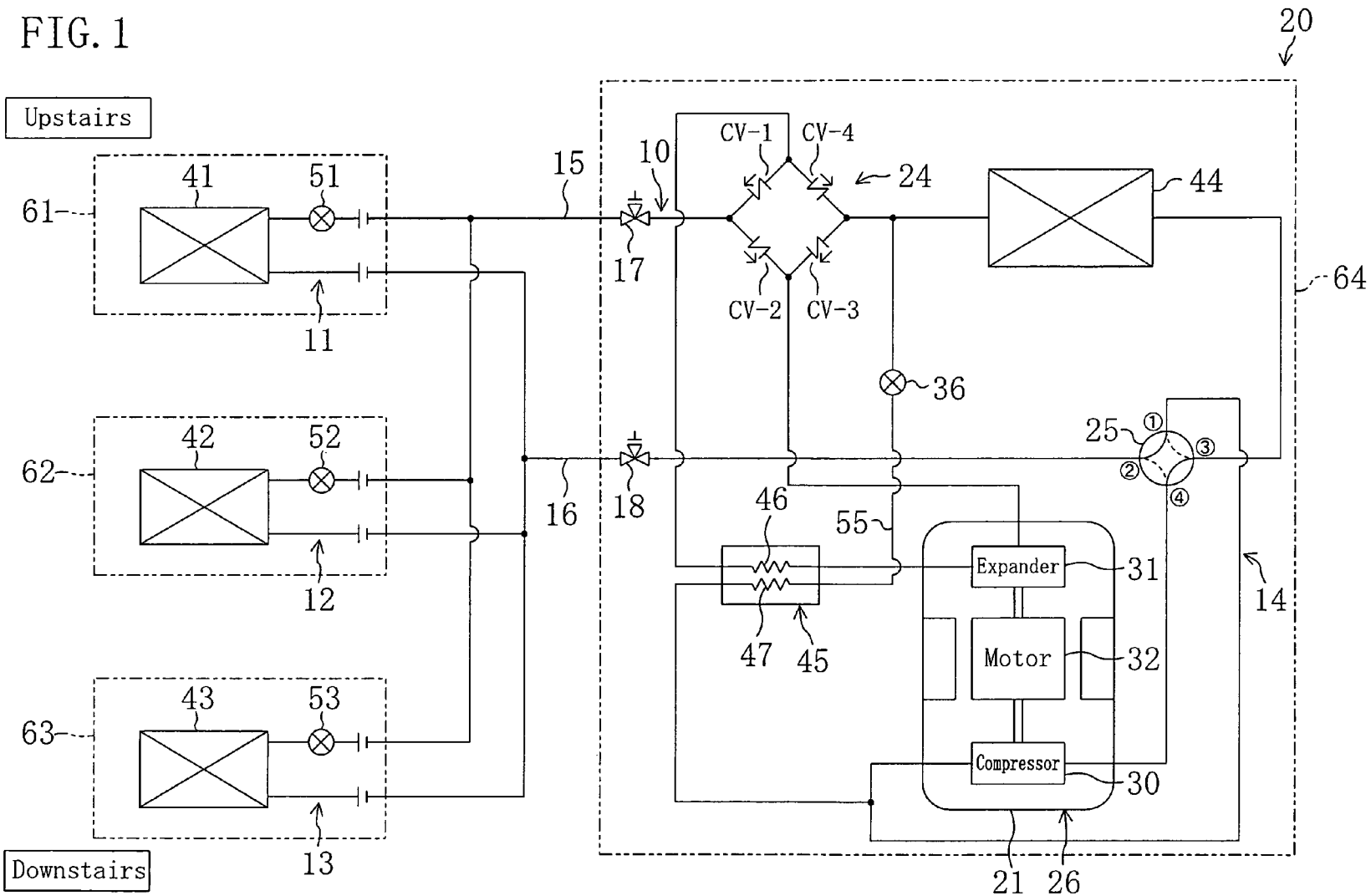
FIG. 1 is a schematic constitutional diagram of an air conditioner in accordance with Embodiment 1.

10 refrigerant circuit
11 indoor circuit (user side circuit)
12 indoor circuit (user side circuit)
13 indoor circuit (user side circuit)
14 outdoor circuit (heat source side circuit)
20 air conditioner (refrigerating apparatus)
30 compressor
30*a* low-stage compression mechanism
30*b* high-stage compression mechanism
31 expander
35 gas-liquid separator
36 cooling expansion valve (cooling means, cooling expansion mechanism)
37 gas pipe
41 indoor heat exchanger (user side heat exchanger)
42 indoor heat exchanger (user side heat exchanger)
43 indoor heat exchanger (user side heat exchanger)
44 outdoor heat exchanger (heat source side heat exchanger)
45 internal heat exchanger (cooling means, cooling heat exchanger)
51 indoor expansion valve (user side expansion valve)
52 indoor expansion valve (user side expansion valve)
53 indoor expansion valve (user side expansion valve)

BEST MODE FOR CARRYING OUT THE INVENTION

Embodiments of the present invention will be described below in detail with reference to the accompanying drawings.

Embodiment 1 of the Invention

Embodiment 1 of the present invention will be described. Embodiment 1 is, as shown in FIG. 1, directed to an air conditioner (20) composed of a refrigerating apparatus in accordance with the present invention. The air conditioner (20) performs vapor compression refrigeration cycle by circulating refrigerant in a refrigerant circuit (10) for performing a cooling operation or a heating operation by switching a four-way switching valve (25) described later. The air conditioner (20) is of generally-called multi type in which three indoor units (61, 62, 63) are provided with respect to a single outdoor unit (64). The number of the indoor units is a mere example.

The indoor units (61, 62, 63) are installed in different floors in a building. The indoor units (61, 62, 63) are an upper floor indoor unit (61), a middle floor indoor unit (62), and a lower floor indoor unit (63). The outdoor unit (64) is installed in the same floor as the lower floor indoor unit (63).

The refrigerant circuit (10) includes three indoor circuits (11, 12, 13) as user side circuits and one outdoor circuit (14) as a heat source side circuit. Carbon dioxide ($CO_2$) is filled as refrigerant in the refrigerant circuit (10). In the refrigerant circuit (10), the three indoor circuits (11, 12, 13) are connected in parallel to the single outdoor circuit (14) by means of a first communication pipe (15) and a second communication pipe (16).

The indoor circuits (11, 12, 13) are accommodated in the indoor units (61, 62, 63), respectively. Indoor heat exchangers (41, 42, 43) as user side heat exchangers and opening variable indoor expansion valves (51, 52, 53) as user side expansion valves are connected in series in the indoor circuits (11, 12, 13), respectively. In each of the indoor units (61, 62, 63), an indoor fan not shown is provided.

Each of the indoor heat exchangers (41, 42, 43) is a cross-fin type fin and tube heat exchanger. Indoor air is supplied to the indoor heat exchangers (41, 42, 43) by the indoor fans not shown. The indoor heat exchangers (41, 42, 43) performs heat exchange between the supplied indoor air and the refrigerant flowing in the indoor heat exchangers (41, 42, 43). Each indoor expansion valve (51, 52, 53) is an electronic expansion valve.

The outdoor circuit (14) is accommodated in the outdoor unit (64). The outdoor circuit (14) includes a compression/expansion unit (26), an outdoor heat exchanger (44), an internal heat exchanger (45) as a cooling heat exchanger, the four-way switching valve (25), a bridge circuit (24), and a cooling expansion valve (36) as a cooling expansion mechanism. The internal heat exchanger (45) and the cooling expansion valve (36) serve as cooling means in accordance with the present invention. The outdoor unit (64) also includes an outdoor fan not shown.

The compression/expansion unit (26) includes a casing (21) as a longitudinal and cylindrical hermetic container. A compressor (30), an expander (31), and a motor (32) are accommodated in the casing (21). In the casing (21), the compressor (30), the expander (31), and the motor (32) are arranged from below to above in this order and are connected to one another by means of a rotary shaft.

The compressor (30) and the expander (31) are composed of fluid machineries of rotary piston type. The compressor (30) compresses the refrigerant to a pressure higher than the critical pressure thereof. Namely, a high pressure of the vapor compression refrigeration cycle becomes higher than the critical pressure of carbon dioxide in the refrigerant circuit (10). The expander (31) recovers power (expansion power) by expanding the refrigerant ($CO_2$) flowing therein. The compressor (30) is rotated and driven by both the power recovered by the expander (31) and power obtained by power conduction to the motor (32). To the motor (32), alternating current power at a predetermined frequency is supplied from an inverter not shown. The compressor (30) is variable in capacity by changing the frequency of the power supplied to the motor (32). The compressor (30) and the expander (31) are rotated at the same rotation speed.

The outdoor heat exchanger (44) is a generally-called cross fin type fin and tube heat exchanger. Outdoor air is supplied to the outdoor heat exchanger (44) by the outdoor fan not shown. The outdoor heat exchanger (44) performs heat exchange between the supplied outdoor air and the refrigerant flowing in the outdoor heat exchanger (44). In the outdoor circuit (14), the outdoor heat exchanger (44) is connected at one end thereof to the third port of the four-way switching valve (25) while being connected at, the other end thereof to the bridge circuit (24).

The cooling expansion valve (36) is variable in opening and is connected at one end thereof to a pipe connecting the indoor heat exchanger (44) and the bridge circuit (24) while being connected at the other end thereof to a pressure reducing pipe (55) connected to the internal heat exchanger (45). The cooling expansion valve (36) is an electronic expansion valve.

The internal heat exchanger (45) includes a first passage (46) and a second passage (47) arranged adjacently to each other so as to perform heat exchange between the refrigerant in the first passage (46) and the refrigerant in the second passage (47). In the outdoor circuit (14), the first passage (46) is connected at one end thereof to the outflow side of the expander (31) while being connected at the other end thereof to the bridge circuit (24). The second passage (47) is connected at one end thereof to the pressure reducing pipe (55) while being connected at the other end thereof to a pipe connecting the suction side of the compressor (30) and the first port of the four-way switching valve (25). The internal heat exchanger (45) performs heat exchange between the refrigerant flowing out from the expander (31) into the first passage (46) in the cooling operation and the refrigerant at a low temperature flowing in the second passage (47) which has been reduced in pressure by the pressure reducing pipe (55).

The bridge circuit (24) is a circuit in which four check valves (CV-1 to CV-4) are connected in bridges. In the bridge circuit (24), the inflow sides of the first check valve (CV-1) and the fourth check valve (CV-4) are connected to the other end of the first passage (46) of the internal heat exchanger (45) while the outflow sides of the second check valve (CV-2) and the third check valve (CV-3) are connected to the inflow side of the expander (31) of the compression/expansion unit (26). Further, in the bridge circuit (24), the outflow side of the first check valve (CV-1) and the inflow side of the second check valve (CV-2) are connected to a first closing valve (17) while the inflow side of the third check valve (CV-3) and the outflow side of the fourth check valve (CV-4) are connected to the other end of the indoor heat exchanger (44).

In the outdoor circuit (14), the first port of the four-way switching valve (25) is connected to the suction side of the compressor (30). The second port thereof is connected to a second closing valve (18). The third port thereof is connected to one end of the indoor heat exchanger (44). The fourth port thereof is connected to the discharge side of the compressor (30). The four-way switching valve (25) switches states between the state where the first port and the second port communicates with each other while the third port and the fourth port are communicates with each other (the state indicated by the solid lines in FIG. 1) and the state where the first port and the third port communicates with each other while the second port and the fourth port are communicates with each other (the state indicated by the broken lines in FIG. 1).

As described above, the three indoor circuits (11, 12, 13) are connected to the single outdoor circuit (14) by means of the first communication pipe (15) and the second communication pipe (16). The first communication pipe (15) is connected at one end thereof to the first closing valve (17). Further, the first communication pipe (15) branches at the other end thereof into three connected to the end portions on the indoor expansion valve (51, 52, 53) sides of the indoor circuits (11, 12, 13). The second communication pipe (16) is connected at one end thereof to the second closing valve (18). Further, the second communication pipe (16) branches at the other end thereof into three connected to the end portions on the indoor heat exchanger (41, 42, 43) sides of the indoor circuits (11, 12, 13).

—Driving Operation—

<Heating Operation>

An operation of the air conditioner (20) in a heating operation will be described.

In the heating operation, the four-way switching valve (25) is switched to the state indicated by the broken lines in FIG. 1 so that each opening of the indoor expansion valves (51, 52, 53) is adjusted individually and the cooling expansion valve (36) is kept closed.

When the compressor (30) is driven in this state, the refrigerant circulates in the refrigerant circuit (10) so that the refrigeration cycle is performed. In this state, the indoor heat exchangers (41, 42, 43) serve as condensers while the outdoor heat exchanger (44) serves as an evaporator.

Specifically, the compressor (30) discharges high-pressure refrigerant which has been compressed to have a pressure higher than the critical pressure thereof. The high-pressure refrigerant passes via the four-way switching valve (25), flows into the second communication pipe (16), and is then distributed to the indoor circuits (11, 12, 13).

In distribution, the refrigerants of which amounts correspond to the openings of the indoor expansion valves (51, 52, 53) are supplied to the indoor circuits (11, 12, 13), respectively.

The high-pressure refrigerants distributed in the indoor circuits (11, 12, 13) are introduced to the indoor heat exchangers (41, 42, 43), respectively, to be heat exchanged with the indoor air. In this heat exchange, the high-pressure refrigerants release heat to the indoor air to heat the indoor air. The refrigerants which have released the heat in the indoor heat exchangers (41, 42, 43) flow together into the first communication pipe (15) and is then sent back to the outdoor circuit (14).

The refrigerant flowing from the first communication pipe (15) in the outdoor circuit (14) passes through the bridge circuit (24) and flows into the expander (31). The refrigerant flowing in the expander (31) is reduced in pressure, flows out therefrom, passes through the first passage (46) of the internal heat exchanger (45) and the bridge circuit (24), and is then introduced into the outdoor heat exchanger (44).

The outdoor heat exchanger (44) performs heat exchange between the thus introduced low-pressure refrigerant and the outdoor air. In this heat exchange, the low-pressure refrigerant absorbs heat from the outdoor air to be evaporated. The refrigerant which has been evaporated in the outdoor heat exchanger (44) is sent to the compressor (30) through the four-way switching valve (25). The refrigerant sucked in the compressor (30) is compressed to be high-pressure refrigerant and is then discharged from the compressor (30) again.

<Cooling Operation>

An operation of the air conditioner (20) in a cooling operation will be described.

In the cooling operation, the four-way switching valve (25) is switched to the state indicated by the solid lines in FIG. 1 so that each opening of the indoor expansion valves (51, 52, 53) is adjusted individually and the opening of the cooling expansion valve (36) is adjusted appropriately.

Wherein, in the air conditioner (20), the indoor units (61, 62, 63) are different from each other in installation level and receive different pressure losses caused in the course of refrigerant flowing from the outdoor circuit (14) to the indoor circuits (11, 12, 13). Specifically, the pressure loss in the lower floor indoor unit (63) is larger than that in the middle floor indoor unit (62) which is larger than that in the upper floor indoor unit (61). In the air conditioner (20), in order to distribute the refrigerant evenly to the indoor units (61, 62, 63), the openings of the indoor expansion valves are set smaller as it goes downstairs.

When the compressor (30) is driven in this state, the refrigerant circulates in the refrigerant circuit (10) so that the refrigeration cycle is performed. In this state, the outdoor heat exchanger (44) serves as a condenser while the indoor heat exchangers (41, 42, 43) serve as evaporators.

Specifically, the compressor (30) discharges high-pressure refrigerant which has been compressed to have a pressure higher than the critical pressure thereof. The high-pressure refrigerant is sent to the outdoor heat exchanger (44) via the four-way switching valve (25). The high-pressure refrigerant introduced in the outdoor heat exchanger (44) is heat exchanged with the outdoor air to release heat to the outdoor air.

The refrigerant which has released the heat in the outdoor heat exchanger (44) is divided into two. One of them passes through the bridge circuit (24) and flows into the expander (31) while the other flows into the pressure reducing pipe (55). The refrigerant flowing in the expander (31) is reduced in pressure and flows out into the first passage (46) of the internal heat exchanger (45). The refrigerant flowing in the pressure reducing pipe (55) is reduced in pressure by the cooling expansion valve (36) and flows into the second passage (47) of the internal heat exchanger (45).

The opening of the cooling expansion valve (36) is adjusted so as to reduce the pressure of the passing refrigerant to a pressure lower than that of the refrigerant reduced in the expander (31). Accordingly, the temperature of the refrigerant flowing in the second passage (47) is lower than that of the refrigerant flowing in the first passage (46).

The refrigerant flowing out from the expander (31) into the first passage (46), which is in the gas-liquid two-phase state where gas refrigerant and liquid refrigerant are present, is cooled in the first passage (46) by the refrigerant flowing in the second passage (47), so that the gas refrigerant is liquefied. Thus, the refrigerant which has passed through the first passage (46) is in a single liquid phase state.

Figure 2:
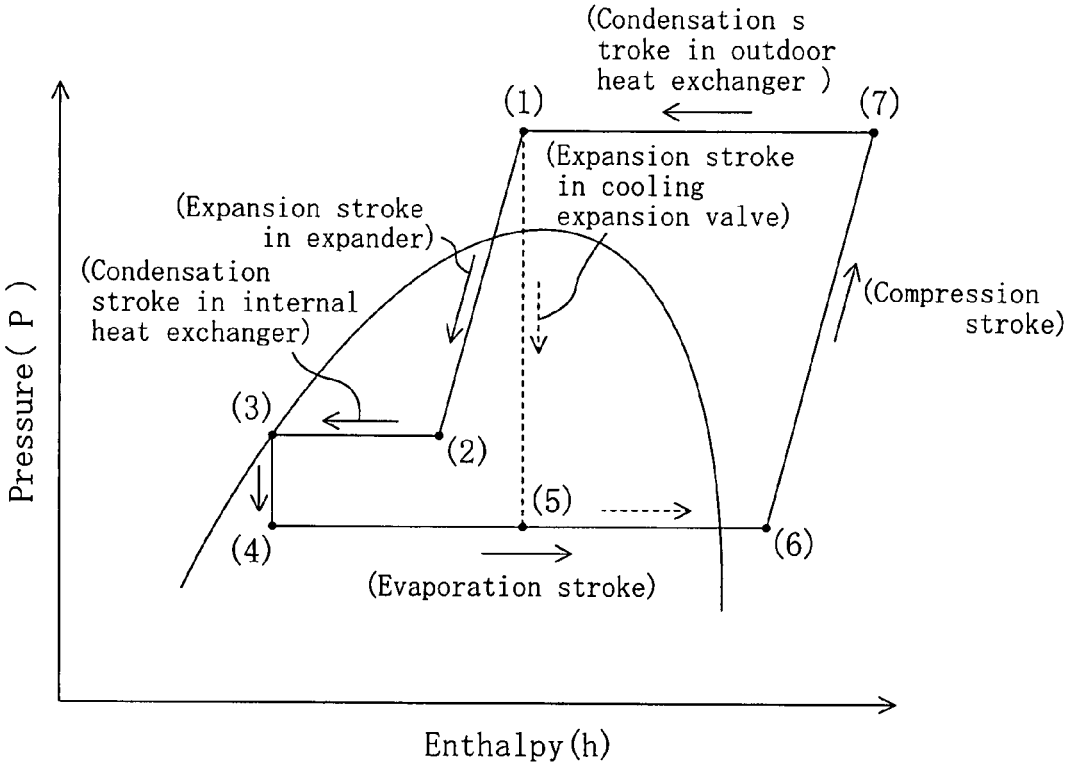
FIG. 2 is a Mollier diagram showing a refrigeration cycle in a cooling operation of the air conditioner in accordance with Embodiment 1.

FIG. 2 is a Mollier diagram in the above refrigeration cycle. The state change of the refrigerant in the expansion stroke in the expander (31) is expressed by change from the point (1) to the point (2). The state change of the refrigerant in the expansion stroke in the cooling expansion valve (36) is expressed by change from the point (1) to the point (5). The state change of the refrigerant in cooling the refrigerant in the first passage (46) of the internal heat exchanger (45) is expressed by change from the point (2) to the point (3). The state change of the refrigerant in cooling the refrigerant in the first passage (46) by the refrigerant passing through the second passage (47) is expressed by change from the point (5) to the point (6).

The liquid refrigerant having passed through the first passage (46) flows into the first communication pipe (15) via the bridge circuit (24) to be distributed into the indoor circuits (11, 12, 13). In distribution, refrigerants of which amounts correspond to the openings of the indoor expansion valves (51, 52, 53) are supplied to the indoor circuits (11, 12, 13), respectively. The liquid refrigerants distributed in the indoor circuits (11, 12, 13) are reduced in pressure by the indoor expansion valves (51, 52, 53) and then flow into the indoor heat exchangers (41, 42, 43), respectively.

The state change of the refrigerant where the refrigerant sent out from the outdoor circuit (14) flows into the indoor circuits (11, 12, 13) is expressed by change (pressure lowering) from the point (3) to the point (4) in FIG. 2. This pressure lowering is caused in the indoor units (11, 12, 13) due to pressure loss in the indoor expansion valves (51, 52, 53) and between the outdoor circuit (14) and the indoor circuits (11, 12, 13). Wherein, the pressure lowering caused due to the pressure loss becomes large as it goes upstairs and becomes small as it goes downstairs. Pressure lowering caused by the indoor expansion valves (51, 52, 53) is adjusted appropriately in the indoor units (61, 62, 63), respectively.

The low-pressure liquid refrigerant introduced in each indoor heat exchanger (41, 42, 43) is heat exchanged with the indoor air. In this heat exchange, the low-pressure liquid refrigerant absorbs heat from the indoor air to be evaporated, with a result that the indoor air is cooled. The refrigerants having absorbed the heat in the indoor heat exchangers (41, 42, 43) flow together into the second communication pipe (16) and are then returned to the outdoor circuit (14). On the other hand, the indoor air cooled in the indoor heat exchangers (41, 42, 43) is supplied indoors as conditioned air.

The refrigerant flowing in the outdoor circuit (14) from the second communication pipe (16) passes through the four-way switching valve (25), is combined with the refrigerant having passed through the second passage (47), and is then sent to the compressor (30). The refrigerant sucked in the compressor (30) is compressed to have a high pressure and is then discharged from the compressor (30) again.

—Effects in Embodiment 1—

In Embodiment 1, the refrigerant in the gas-liquid two-phase state flowing out from the expander (31) is cooled by the cooling means (36, 45) of the outdoor circuit (14) in the cooling operation to be forcedly in the single liquid phase state and is then distributed to the indoor circuits (11, 12, 13). In other words, the refrigerant in the liquid single phase state flows in the pipe where the refrigerant flows from the outdoor circuit (14) to the indoor circuits (11, 12, 13) in the cooling operation so that the liquid refrigerant is supplied to the indoor circuits (11, 12, 13). Since the liquid refrigerant is supplied to the indoor circuits (11, 12, 13), no imbalance in the state of the refrigerant (a ratio of the liquid refrigerant to the gas refrigerant) is caused even in the case as in Embodiment 1 where difference in installation level between the indoor units (61, 62, 63) causes difference in pressure loss caused in the course of refrigerant flowing from the outdoor circuit (14) to the indoor circuits (11, 12, 13). Accordingly, each amount of the refrigerants supplied to the indoor circuits (11, 12, 13) can be controlled appropriately when compared with the case where the refrigerant in the gas-liquid two-phase state is supplied from the outdoor circuit (14) to the indoor circuits (11, 12, 13). Hence, the controllability on cooling capacity in the cooling operation can be enhanced in each of the indoor circuits (11, 12, 13) irrespective of the location of the indoor circuits (11, 12, 13).

Further, in Embodiment 1, the opening variable indoor expansion valves (51, 52, 53) are provided in the indoor circuits (11, 12, 13), respectively, so that the expansion stroke of the refrigeration cycle is performed also in the indoor circuits (11, 12, 13). Hence, the indoor expansion valves (51, 52, 53) adjust the difference in pressure loss between the indoor circuits (11, 12, 13) in the case as in Embodiment 1 where the indoor circuits (11, 12, 13) are different from each other in pressure loss caused in the course of refrigerant flowing from the outdoor circuit (14) to the indoor circuits (11, 12, 13) with the presence of difference in installation level between the indoor units (61, 62, 63). In short, adjustment of each opening of the indoor expansion valves (51, 52, 53) achieves arbitrary setting of each amount of the refrigerants flowing in the indoor circuits (11, 12, 13) in Embodiment 1. In consequence, each amount of the refrigerants supplied to the indoor circuits (11, 12, 13) are controlled appropriately irrespective of the location of the indoor circuits (11, 12, 13), thereby enhancing the controllability on cooling capacity of each indoor circuit (11, 12, 13) in the cooling operation.

In addition, in Embodiment 1, carbon dioxide ($CO_2$) is used as the refrigerant filled in the refrigerant circuit (10) for allowing the refrigerant circuit (10) to perform the supercritical cycle where the pressure of the refrigerant in the refrigeration cycle is higher than the critical pressure of the refrigerant, so that the refrigerant discharged from the compressor (30) is in an overheated state definitely. This means that even if the compressor (30) sucks damp refrigerant, the refrigerant discharged from the compressor (30) is already overheated to prevent liquid compression in the compressor (30) definitely. As a result, the reliability of the air conditioner (20) increases.

Modified Example 1 of Embodiment 1

Figure 3:
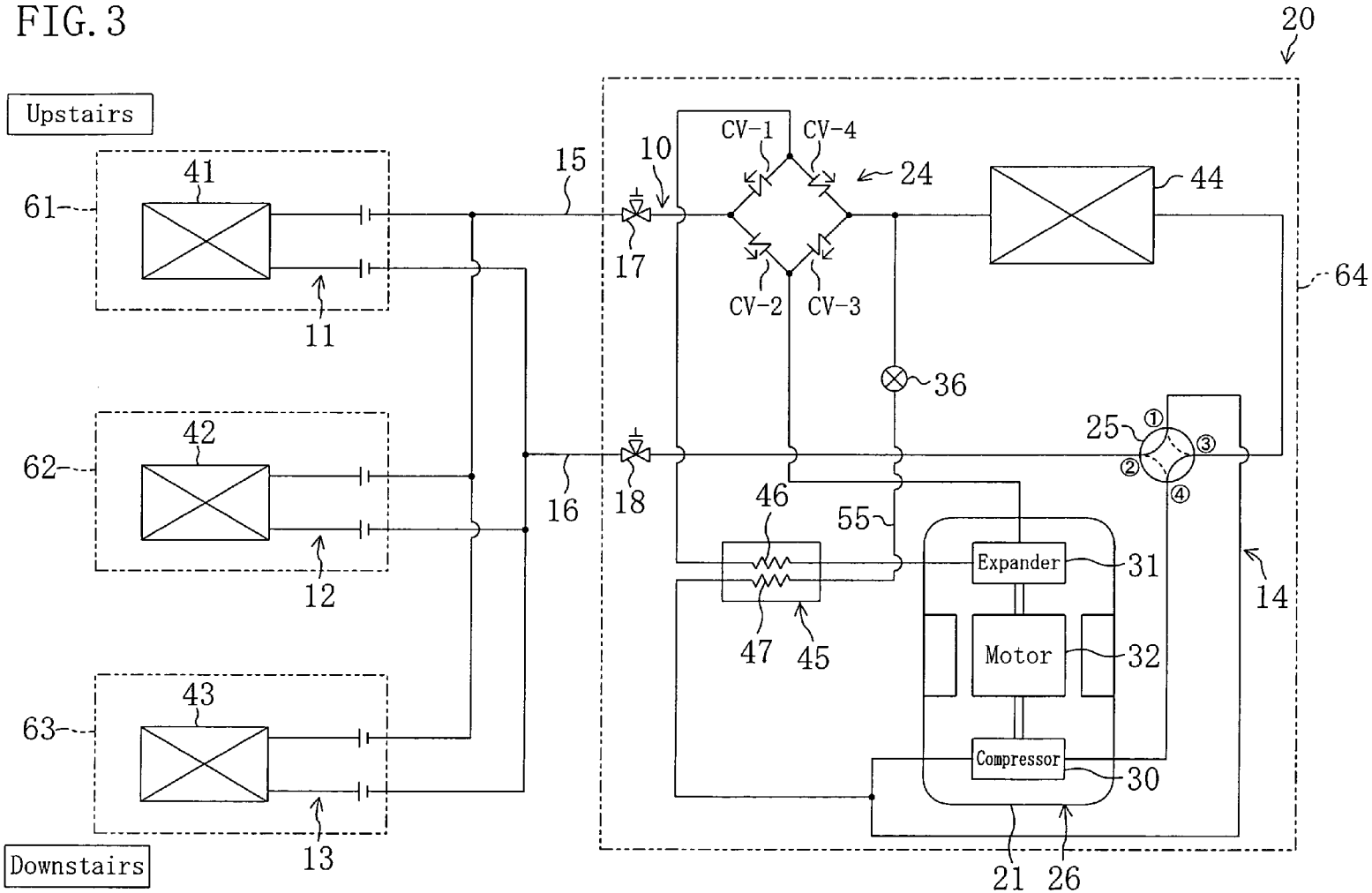
FIG. 3 is a schematic constitutional diagram of an air conditioner in accordance with Modified Example 1 of Embodiment 1.

Modified Example 1 will be described. FIG. 3 shows a schematic construction of an air conditioner (20) of Modified Example 1. The air conditioner (20) of Modified Example 1 includes no indoor expansion valves (51, 52, 53) in the indoor circuits (11, 12, 13). In the air conditioner (20), only the expander (31) of the outdoor circuit (14) performs the expansion stroke of the refrigeration cycle.

In the air conditioner (20), the refrigerant expanded in the expander (31) of the outdoor circuit (64) is cooled in the internal heat exchanger (45) to be changed in state from the gas-liquid two-phase state to the single liquid phase state and is then introduced into the indoor heat exchanger (41, 42, 43) of the indoor circuits (11, 12, 13).

If the difference in installation level between the indoor units (61, 62, 63) and the outdoor unit (64) is small and the indoor units (61, 62, 63) are installed substantially on a level, the air conditioner (20) of Modified Example 1 can distribute the refrigerant evenly to the indoor circuits (11, 12, 13) with no indoor expansion valves (51, 52, 53) provided. With no refrigerant expanded in the indoor circuits (11, 12, 13), the expander (31) can recover much more power generated in association with expansion of the refrigerant.

Embodiment 2

Figure 4:
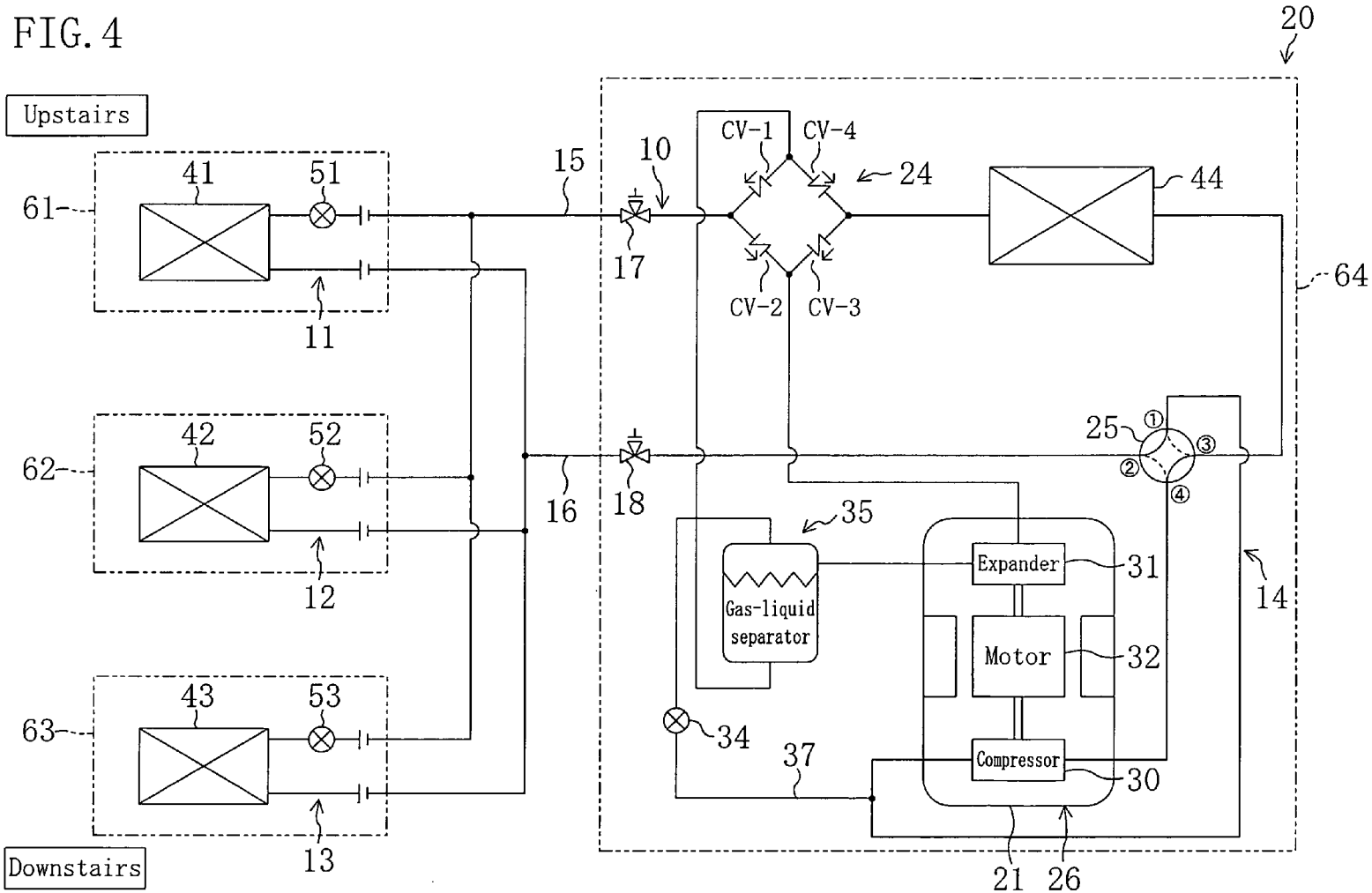
FIG. 4 is a schematic constitutional diagram of an air conditioner in accordance with Embodiment 2.

Embodiment 2 of the present invention will be described. FIG. 4 shows a schematic construction of an air conditioner (20) of Embodiment 2. The air conditioner (20) includes a gas-liquid separator (35) in place of the internal heat exchanger (45) in the outdoor circuit (14). Further, no pressure reducing pipe (55) is included.

Specifically, the gas-liquid separator (35) is a longitudinal and cylindrical hermetic container having a top face, a bottom face, and a side face to which pipes are connected. The pipe connected to the top face of the gas-liquid separator (35) forms a gas pipe (37) which is connected to a pipe that connects the suction side of the compressor (30) and the first port of the four-way switching valve (25) and in which an expansion valve (34) is provided. The pipe connected to the bottom face thereof is connected to the inflow sides of the first check valve (CV-1) and the fourth check valve (CV-4) of the bridge circuit (24). The pipe connected to the side face thereof is connected to the outflow side of the expander (31) and passes through a comparatively upper part of the side face thereof so as to be open to the gas space in the gas-liquid separator (35).

In the refrigerating apparatus of Embodiment 2, the refrigerant flowing out from the expander (31) flows into the gas-liquid separator (35) to be separated into the liquid refrigerant and the gas refrigerant in the cooling operation. The liquid refrigerant out of them flows out from the pipe connected to the bottom of the gas-liquid separator (35), passes through the bridge circuit (24), and is then distributed to the indoor circuits (11, 12, 13). On the other hand, the gas refrigerant flows out from the gas pipe (37) and is then reduced in pressure by the expansion valve (34). After reduced in pressure by the expansion valve (34), the gas refrigerant is combined with the refrigerant flowing from the first port of the four-way switching valve (25) toward the suction side of the compressor (30) to be sucked into the compressor (30). The opening of the expansion valve (34) is controlled so that the liquid level in the gas-liquid separator (35) is almost fixed.

—Effects of Embodiment 2—

In Embodiment 2, the gas-liquid separator (35) allows the refrigerant sent from the outdoor circuit (14) to the indoor circuits (11, 12, 13) to be in the single liquid phase state in the cooling operation. Further, the opening variable indoor expansion valves (51, 52, 53) are provided in the indoor circuits (11, 12, 13), respectively, so that the expansion stroke of the refrigeration cycle is performed not only in the outdoor circuit (14) but also in the indoor circuits (11, 12, 13). Though this causes difference between the indoor circuits (11, 12, 13) in pressure loss caused in the course of refrigerant flowing from the outdoor circuit (14) to the indoor circuits (11, 12, 13), the gas-liquid separator (35) prevents imbalance in the state of the refrigerant supplied between the indoor circuits (11, 12, 13). Further, adjustment of each opening of the indoor expansion valves (51, 52, 53) achieves arbitrary setting of each amount of the refrigerants flowing in the indoor circuits (11, 12, 13). Hence, each amount of the refrigerants supplied to the indoor circuits (11, 12, 13) can be controlled appropriately irrespective of the location of the indoor circuits (11, 12, 13), thereby enhancing the controllability on cooling capacity of each indoor circuit (11, 12, 13) in the cooling operation.

Modified Example 1 of Embodiment 2

Figure 5:
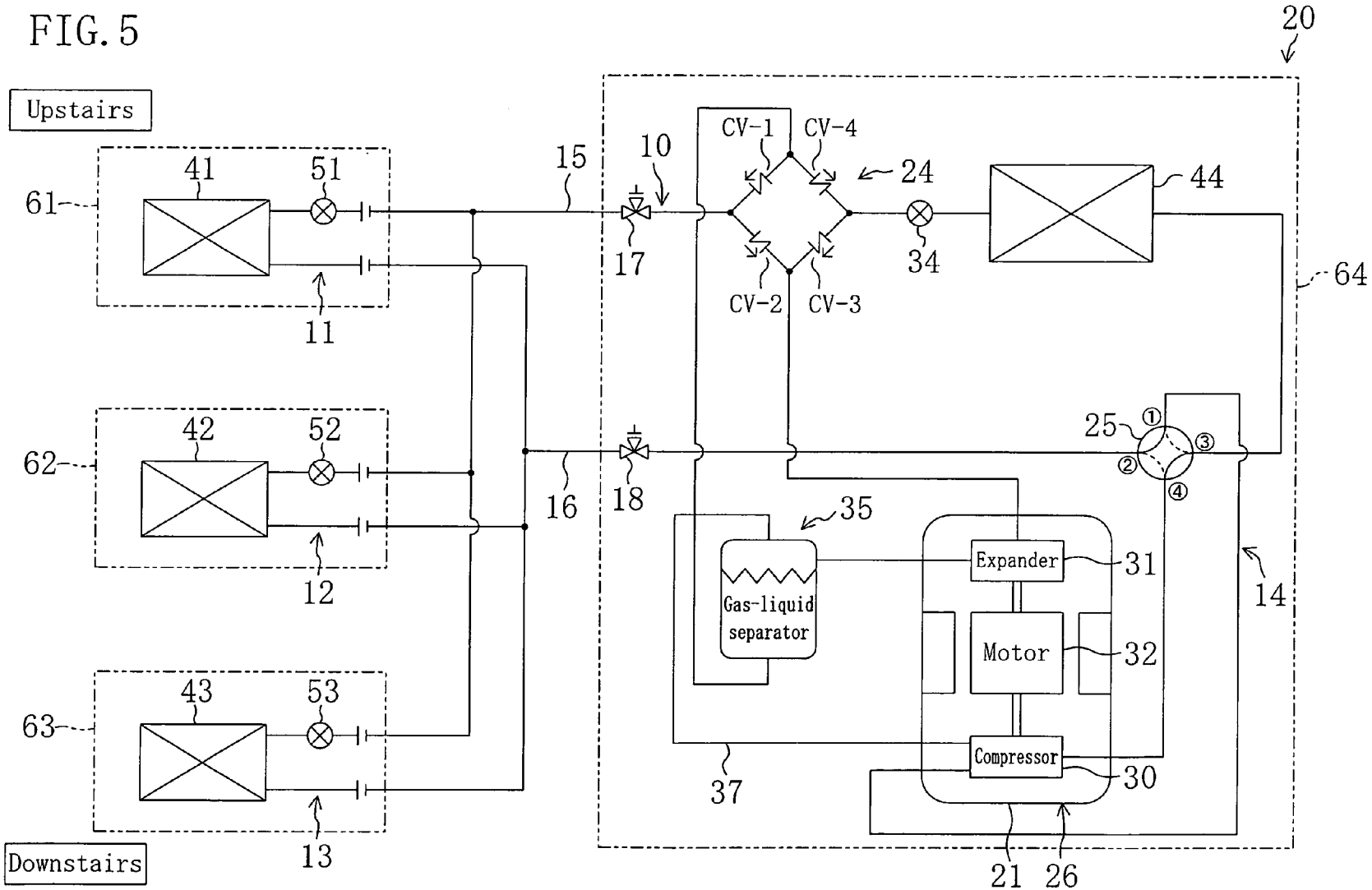
FIG. 5 is a schematic constitutional diagram of an air conditioner in accordance with Modified Example 1 of Embodiment 2.

Modified Example 1 of Embodiment 2 will be described. FIG. 5 shows a schematic construction of an air conditioner (20) of Modified Example 1. In Modified Example 1, the gas pipe (37) is connected to the compressor (30) so that the gas refrigerant in the gas-liquid separator (35) is introduced from the gas pipe (37) in the middle of the compression stroke of the compressor (30). In addition, the expansion valve (34) is provided between the bridge circuit (24) and the outdoor heat exchanger (44).

In Modified Example 1, the refrigerant is reduced in pressure by the indoor expansion valves (51, 52, 53) of the indoor circuits (11, 12, 13), so that the pressure of the refrigerant flowing into the indoor circuits (11, 12, 13) is higher than the pressure of the refrigerant flowing out from the indoor circuits (11, 12, 13). The pressure of the refrigerant flowing into the indoor circuits (11, 12, 13) is almost equal to the pressure of the refrigerant in the gas-liquid separator (35) while the pressure of the refrigerant flowing out from the indoor circuits (11, 12, 13) is almost equal to the pressure of the refrigerant on the suction side of the compressor (30). In other words, in Modified Example 1, the gas refrigerant in a saturated state at a pressure higher than that of the refrigerant introduced in the compressor (30) from the indoor circuits (11, 12, 13) is introduced from the gas-liquid separator (35) to the gas pipe (37) in the middle of the compression stroke of the compressor (30). Hence, the enthalpy of the refrigerant in the compressor (30) lowers to reduce power required for compression in the compressor (30), thereby implementing an increase in COP (coefficient of performance). In addition, the temperature of the refrigerant discharged from the compressor (30) lowers to suppress degradation of the oil and decomposition of the refrigerant.

Modified Example 2 of Embodiment 2

Figure 6:
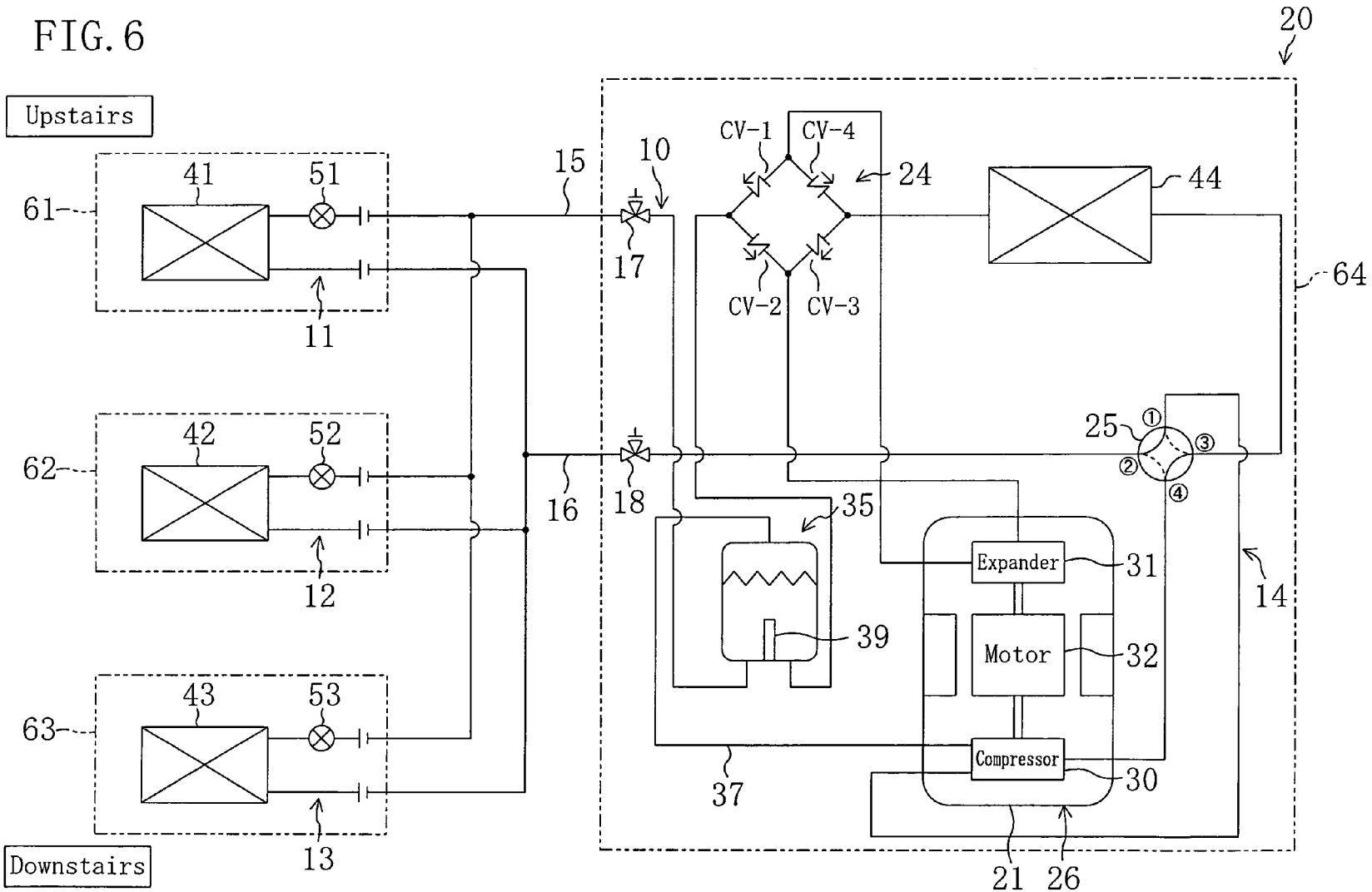
FIG. 6 is a schematic constitutional diagram of an air conditioner in accordance with Modified Example 2 of Embodiment 2.

Difference of Modified Example 2 from Modified Example 1 of Embodiment 2 will be described. FIG. 6 shows a schematic construction of an air conditioner (20) of the present modified example.

The gas-liquid separator (35) includes a top face to which one pipe is connected and a bottom face to which two pipes are connected. The gas-liquid separator (35) is provided with a baffle board (39) separating the lower part of the inner space thereof into two. The two pipes connected to the bottom face of the gas-liquid separator (35) are open at parts apart form each other with the baffle board (39) interposed. The pipe connected to the top face thereof forms the gas pipe (37) connected to the compressor (30) so that the gas refrigerant in the gas-liquid separator is introduced in the middle of the compression stroke of the compressor (30), similarly to Modified Example 1. One of the pipes connected to the bottom face thereof is connected to the first closing valve (17) while the other thereof is connected to the outflow side of the first check valve (CV-1) and the inflow side of the second check valve (CV-2) of the bridge circuit (24). The outflow side of the expander (31) is connected to the inflow sides of the first check valve (CV-1) and the fourth check valve (CV-4) of the bridge circuit (24).

In the cooling operation, the refrigerant in the gas-liquid two-phase state from the expander (31) flows from the right pipe connected at the bottom face of the gas-liquid separator (35), and therefore, the baffle board (39) is provided for preventing the gas refrigerant mixed with the liquid refrigerant from flowing out from the left pipe connected at the bottom face thereof.

In Modified Example 2, the expansion valve (34) can be dispensed with, thereby reducing the cost for manufacturing the air conditioner (20).

Modified Example 3 of Embodiment 2

Figure 7:
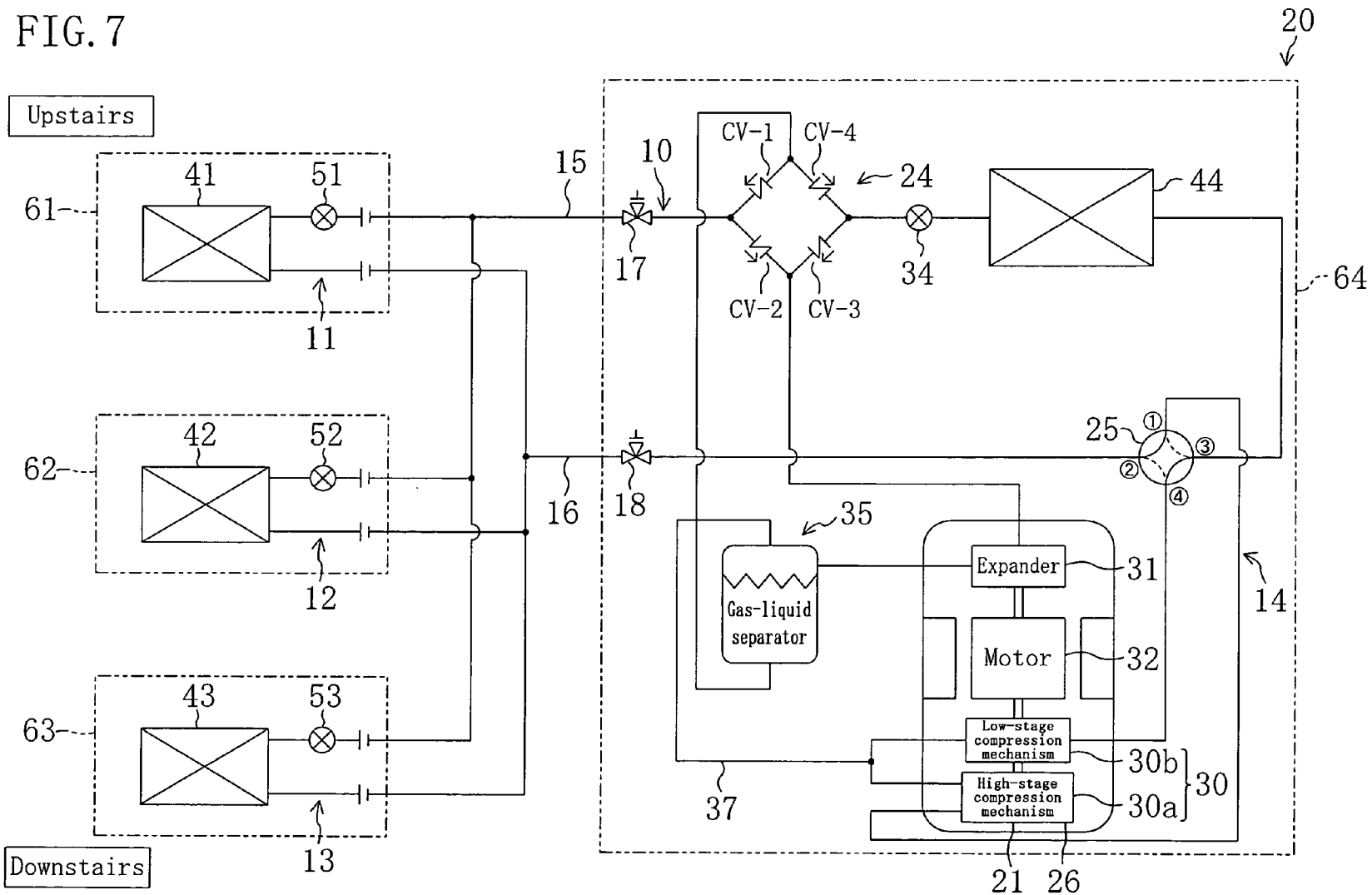
FIG. 7 is a schematic constitutional diagram of an air conditioner in accordance with Modified Example 3 of Embodiment 2.

Difference of Modified Example 3 from Modified Example 1 of Embodiment 2 will be described. FIG. 7 shows a schematic construction of an air conditioner (20) of Modified Example 3.

In Modified Example 3, the compressor (30) is composed of a low-stage compression mechanism (30*a*) and a high-stage compression mechanism (30*b*). The low-stage compression mechanism (30*a*) and the high-stage compression mechanism (30*b*) are connected to each other in series. Specifically, the compressor (30) is so composed that the high-stage compression mechanism (30*b*) sucks to compress further the refrigerant compressed in the low-stage compression mechanism (30*a*). The gas pipe (37) is connected at the connection part between the low-stage compression mechanism (30*a*) and the high-stage compression mechanism (30*b*).

In Modified Example 3, the gas refrigerant in the saturated state at a pressure higher than that of the refrigerant sucked in the low-stage compression mechanism (30*a*) is introduced from the gas-liquid separator (35) to the high-stage compression mechanism (30*b*) through the gas pipe (37). Hence, the enthalpy of the refrigerant sucked in the high-stage compression mechanism (31*b*) lowers to reduce power required for compression in the high-stage compression mechanism (31*a*), thereby contemplating an increase in COP (coefficient of performance). Further, the temperature of the refrigerant discharged from the high-stage compression mechanism (30*b*) lowers to suppress degradation of the oil and decomposition of the refrigerant.

Modified Example 4 of Embodiment 2

Figure 8:
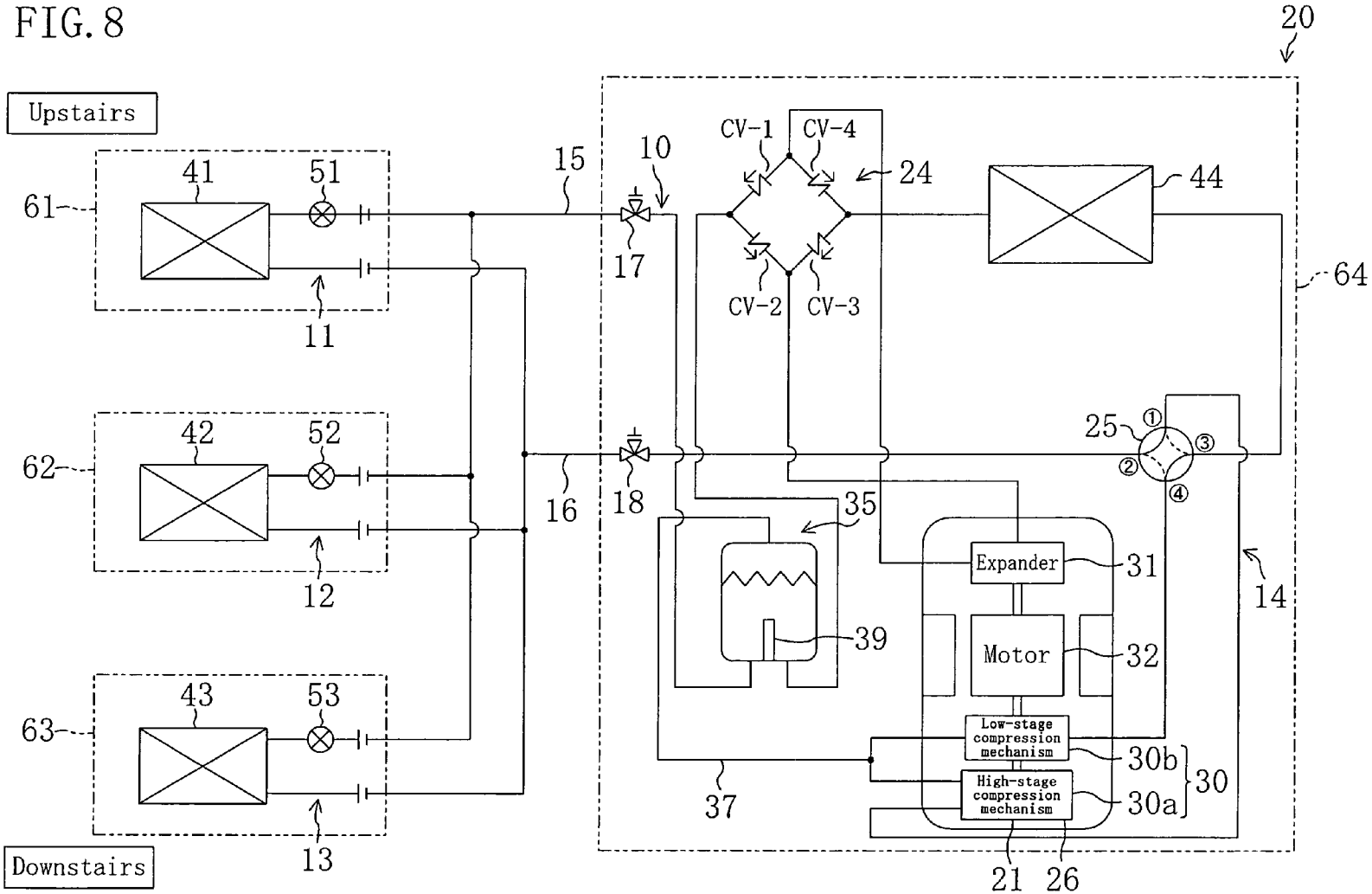
FIG. 8 is a schematic constitutional diagram of an air conditioner in accordance with Modified Example 4 of Embodiment 2.

Difference of Modified Example 4 from Modified Example 2 of Embodiment 2 will be described. FIG. 8 shows a schematic construction of a refrigerating apparatus of the present modified example.

In Modified Example 4, the compressor (30) is composed of the low-stage compression mechanism (30*a*) and the high-stage compression mechanism (30*b*). The low-stage compression mechanism (30*a*) and the high-stage compression mechanism (30*b*) are connected to each other in series. Specifically, the compressor (30) is so composed that the high-stage compression mechanism (30*b*) sucks to compress further the refrigerant compressed in the low-stage compression mechanism (30*a*). The gas pipe (37) is connected at the connection part between the low-stage compression mechanism (30*a*) and the high-stage compression mechanism (30*b*).

In Modified Example 4, the gas refrigerant in the saturated state at a pressure higher than that of the refrigerant sucked in the low-stage compression mechanism (30*a*) is introduced from the gas-liquid separator (35) to the high-stage compression mechanism (30*b*) through the gas pipe (37). Hence, the enthalpy of the refrigerant sucked in the high-stage compression mechanism (31*b*) lowers to reduce power required for compression in the high-stage compression mechanism (31*a*), thereby contemplating an increase in COP (coefficient of performance). Further, the temperature of the refrigerant discharged from the high-stage compression mechanism (30*b*) lowers to suppress degradation of the oil and decomposition of the refrigerant.

The above described embodiments are essentially preferred examples and are not intended to limit the scope of the present invention, applicable matters, and use.

INDUSTRIAL APPLICABILITY

As described above, the present invention is useful for multi type refrigerating apparatuses in which a plurality of user side circuits are connected in parallel to a heat source side circuit.

The invention claimed is:

1. A refrigerating apparatus which includes a refrigerant circuit performing a refrigeration cycle by circulating refrigerant, the refrigerant circuit including: a heat source circuit provided with a compressor, an expander, and a heat source side heat exchanger and a plurality of user side circuits respectively provided with user side heat exchangers and connected in parallel to the heat source side circuit, and which is capable of performing a cooling operation where the heat source side heat exchanger serves as a condenser while the user side heat exchangers serve as evaporators, wherein the heat source side circuit includes cooling means for cooling the refrigerant sent from the expander to the user side circuits in the cooling operation, wherein the user side circuits include opening variable user side expansion valves on upstream sides in the cooling operation of the user side heat exchangers, respectively.

2. The refrigerating apparatus of claim 1, wherein the cooling means includes a cooling expansion mechanism which reduces a pressure of a part of the refrigerant having been condensed in the heat source side heat exchanger and flowing therein and a cooling heat exchanger which cools the refrigerant sent from the expander to the user side circuits by heat exchange with the refrigerant of which pressure has been reduced in the cooling expansion mechanism.

3. A refrigerating apparatus which includes a refrigerant circuit performing a refrigeration cycle by circulating refrigerant, the refrigerant circuit including: a heat source circuit provided with a compressor, an expander, and a heat source side heat exchanger and a plurality of user side circuits respectively provided with user side heat exchangers and connected in parallel to the heat source side circuit, and which is capable of performing a cooling operation where the heat source side heat exchanger serves as a condenser while the user side heat exchangers serve as evaporators, wherein the user side circuits include opening variable user side expansion valves on upstream sides in the cooling operation of the user side heat exchangers, respectively, and the heat source side circuit includes a gas-liquid separator for separating the refrigerant flowing from the expander into liquid refrigerant and gas refrigerant and for sending the liquid refrigerant to the user side circuits.

4. The refrigerating apparatus of claim 3, wherein a gas pipe for sending the gas refrigerant in the gas-liquid separator to the compressor is mounted at the gas-liquid separator.

5. The refrigerating apparatus of claim 3, wherein the compressor includes a low-stage compression mechanism and a high-stage compression mechanism which are connected to each other in series, the high-pressure compression mechanism compressing further refrigerant having been compressed in the low-stage compression mechanism, and a gas pipe for sending the gas refrigerant in the gas-liquid separator to the high-stage compression mechanism is mounted at the gas-liquid separator.

6. The refrigerating apparatus of any one of claims 1 to 5, wherein the refrigerant circuit is set so that a high pressure of the refrigeration cycle is higher than a critical pressure of the refrigerant.

* * * * *